US011670897B2

(12) United States Patent
Aboulkassem et al.

(10) Patent No.: US 11,670,897 B2
(45) Date of Patent: Jun. 6, 2023

(54) PLUG CONNECTORS FOR A PLUG CONNECTOR SYSTEM, PLUG CONNECTOR SYSTEM AND METHOD FOR PRODUCING A PLUG CONNECTOR SYSTEM

(71) Applicant: TE Connectivity Germany GmbH, Bensheim (DE)

(72) Inventors: Samir Aboulkassem, Bensheim (DE); Matthias Weidner, Bensheim (DE); Hans-Dieter Fuhry, Bensheim (DE); Joerg Bernstorf, Bensheim (DE)

(73) Assignee: TE Connectivity Germany GmbH, Bensheim (DE)

( * ) Notice: Subject to any disclaimer, the term of this patent is extended or adjusted under 35 U.S.C. 154(b) by 27 days.

(21) Appl. No.: 17/358,624

(22) Filed: Jun. 25, 2021

(65) Prior Publication Data

US 2021/0408733 A1 Dec. 30, 2021

(30) Foreign Application Priority Data

Jun. 25, 2020 (DE) ..... 10 2020 116 736.9

(51) Int. Cl.
*H01R 13/6583* (2011.01)
*H01R 9/05* (2006.01)
(Continued)

(52) U.S. Cl.
CPC ..... *H01R 13/6583* (2013.01); *H01R 9/05* (2013.01); *H01R 13/112* (2013.01); *H01R 13/629* (2013.01); *H01R 2103/00* (2013.01)

(58) Field of Classification Search
CPC .... H01R 2103/00; H01R 9/0518; H01R 9/05; H01R 13/6583; H01R 13/112; H01R 13/629
(Continued)

(56) References Cited

U.S. PATENT DOCUMENTS 6,287,144 B1 * 9/2001 Baffert ..... H01R 9/05 439/582
6,948,977 B1 9/2005 Behrent
(Continued)

FOREIGN PATENT DOCUMENTS

DE 90 03 258.6 U1 5/1990
DE 94 21 306 U1 9/1995
(Continued)

OTHER PUBLICATIONS

Extended European Search Report in Appln. No. 21181550.1-1201, dated Nov. 15, 2021, 7 pp.
(Continued)

*Primary Examiner* — Gary F Paumen
(74) *Attorney, Agent, or Firm* — Barley Snyder

(57) ABSTRACT

A plug connector system comprises a first plug connector and a second plug connector. The first plug connector includes a first shield defining an engagement portion, with an outer side of the engagement portion having a marking positioned thereon. The second plug connector includes a second shield defining a receiving portion for receiving the engagement portion of the first shield. The receiving portion includes an opening formed therethrough and positioned such that the marking of the first plug connector can be arranged entirely within the region of the opening in a mated state of the first and second plug connectors.

20 Claims, 8 Drawing Sheets

(51) Int. Cl.
*H01R 13/11* (2006.01)
*H01R 13/629* (2006.01)
*H01R 103/00* (2006.01)

(58) Field of Classification Search
USPC ..... 439/910, 582
See application file for complete search history.

(56) References Cited

U.S. PATENT DOCUMENTS

| | | | | |
|---|---|---|---|---|
| 8,858,258 | B2 * | 10/2014 | Stokowski | H01R 13/533 439/582 |
| 2004/0137790 | A1 * | 7/2004 | Lee | H01R 4/28 439/582 |
| 2005/0164551 | A1 | 7/2005 | Wlos | |
| 2009/0017678 | A1 * | 1/2009 | Meier | H01R 9/0518 439/582 |

FOREIGN PATENT DOCUMENTS

| | | | |
|---|---|---|---|
| EP | 047660 | A1 | 9/1991 |
| EP | 2053705 | A2 | 4/2009 |

OTHER PUBLICATIONS

English Abstract of EP0447660A1, published Sep. 25, 1991, 1p.
English Abstract of EP2053705A2, published Apr. 29, 2009, 1p.
German Office Action, dated Feb. 4, 2021, 8 pages.

* cited by examiner

PLUG CONNECTORS FOR A PLUG CONNECTOR SYSTEM, PLUG CONNECTOR SYSTEM AND METHOD FOR PRODUCING A PLUG CONNECTOR SYSTEM

CROSS-REFERENCE TO RELATED APPLICATIONS

This application claims priority under 35 U.S.C. § 119 to German Patent Application No. DE 10 2020 116 736.9, filed on Jun. 25, 2020, the entire disclosure of which is incorporated herein by reference.

FIELD OF THE INVENTION

The present invention relates to electrical plug connectors, and more particularly, to a plug connector system or assembly which aids a user in determining a proper relative orientation of plug connectors of the assembly in a mated state.

BACKGROUND

Plug connector systems or assemblies typically comprise first and second plug connectors which are selectively mated together to form an electrical connection. In certain systems, for example many coaxial plug connector systems, the first and second plug connectors remain moveable (e.g., axially translatable and/or rotatable) relative to one another in a state where they appear to be properly mated. In this way, during the assembly of such a plug connector system, it is possible for a user to inadvertently join the first and second plug connectors in an incorrect relative orientation, without any easily identifiable visual indication of the deficiency. This incorrect orientation may result in, for example, a mechanically or electrically unstable connection, as well as the improper alignment of shielding elements and/or fastening features of the first and second plug connectors.

Accordingly, improved plug connector systems are desired which provide a user with a visual indication of a relative plug position or plug alignment in a mated state of the system.

SUMMARY

According to an embodiment of the present disclosure, a plug connector system comprises a first plug connector and a second plug connector. The first plug connector includes a first shield defining an engagement portion, with an outer side of the engagement portion having a marking positioned thereon. The second plug connector includes a second shield defining a receiving portion for receiving the engagement portion of the first shield. The receiving portion includes an opening formed therethrough and positioned such that the marking of the first plug connector can be arranged entirely within the region of the opening in a mated state of the first and second plug connectors.

BRIEF DESCRIPTION OF THE DRAWINGS

The invention will now be described by way of example with reference to the accompanying Figures, of which.

DETAILED DESCRIPTION OF THE EMBODIMENTS

Figure 1:
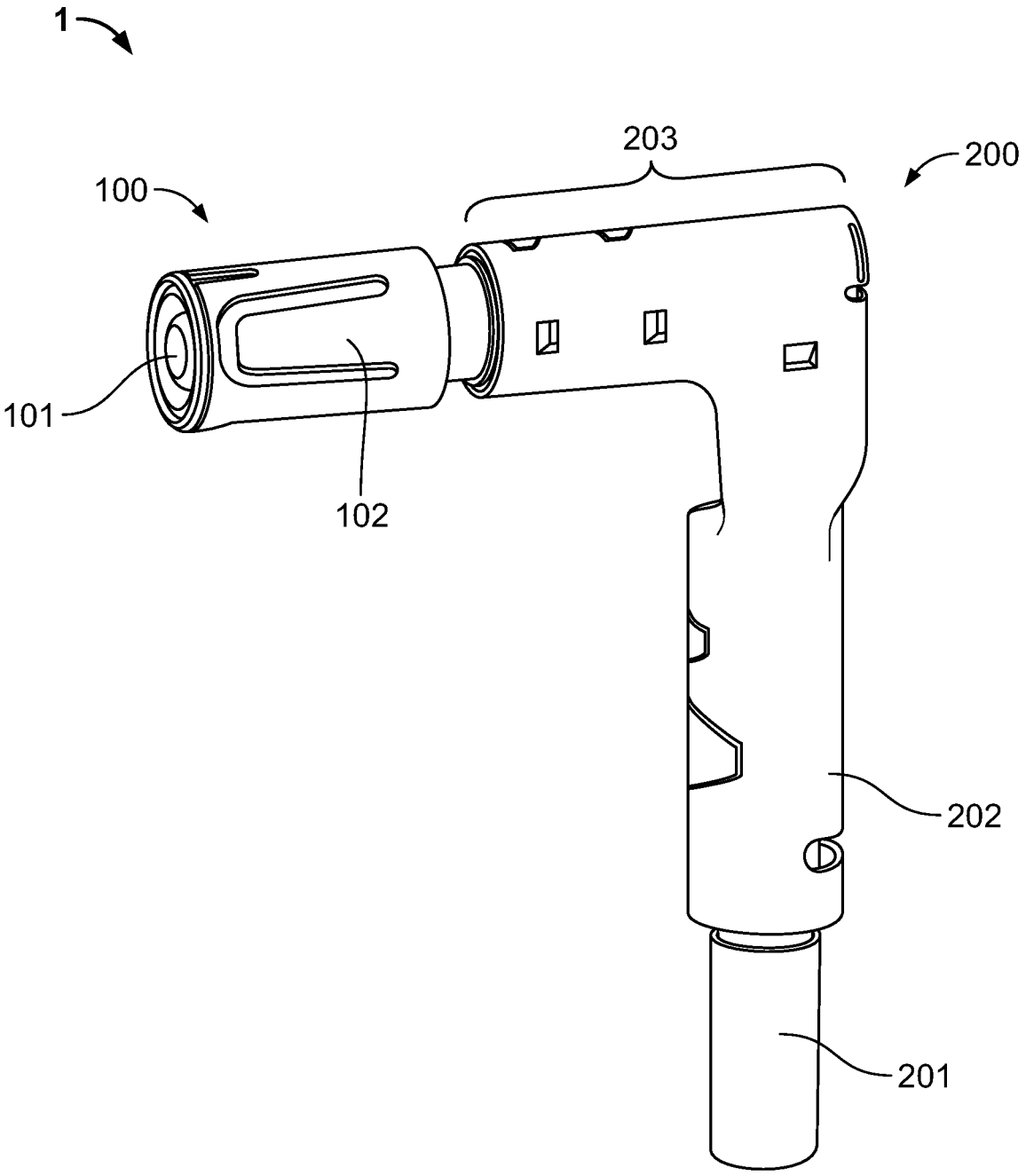
FIG. 1 shows a plug connector system in a perspective view.

Exemplary embodiments of the present disclosure will be described hereinafter in detail with reference to the attached drawings, wherein the like reference numerals refer to the like elements. The present disclosure may, however, be embodied in many different forms and should not be construed as being limited to the embodiment set forth herein; rather, these embodiments are provided so that the present disclosure will be thorough and complete, and will fully convey the concept of the disclosure to those skilled in the art.

In the following detailed description, for purposes of explanation, numerous specific details are set forth in order to provide a thorough understanding of the disclosed embodiments.

It will be apparent, however, that one or more embodiments may be practiced without these specific details. In other instances, well-known structures and devices are schematically shown in order to simplify the drawing.

FIG. 1 schematically shows a plug connector system 1 in a perspective view. The plug connector system 1 is designed as a coaxial connection system and can be used to transmit data, by way of example only.

The plug connector system 1 has a first plug connector 100 and a second plug connector 200. The first plug connector 100 is embodied as an adapter, by way of example only. A coaxial cable, for example, can be connected to a first connection 101 of the first plug connector 100. A coaxial cable connected to the first connection 101 of the first plug connector 100 can in turn be connected to a connection of a printed circuit board or other device, for example. The second plug connector 200 is connected, by way of example, to a coaxial cable 201. However, the coaxial cable 201 of the plug connector system 1 of FIG. 1 can also be omitted. It is also possible that the first plug connector 100 is provided to receive a coaxial cable 201, while the second plug connector 200 can be embodied as an adapter.

The first plug connector 100 has a first shield 102 including an engagement portion 103. The first shield 102 can contain copper or another electrically conductive material, for example. The first shield 102 can be tin-plated, for example, whereby a corrosion-resistance of the first shield 102 can be improved, for example. The first shield 102 can also have another coating whereby the corrosion-resistance or other properties can be improved. The second plug connector 200 has a second shield 202 including a receiving portion 203. The second shield 202 can contain stainless steel or another electrically conductive material, for example. The second shield 202 can likewise be tin-plated, for example, or also have another coating. The engagement portion 103 cannot be seen in FIG. 1 as the engagement portion 103 of the first shield 102 of the first plug connector 100 engages in the receiving portion 203 of the second shield 202 of the second plug connector 200.

By way of example, the plug connector system 1 of FIG. 1 has an angled design, wherein the first shield 102 is arranged perpendicularly to a portion of the second shield 202 which is designed to receive the coaxial cable 201. However, the plug connector system 1 can also have a different design. For example, the plug connector system 1 can also have a linear design, wherein the first and second shields, and the coaxial cable are arranged generally coaxially.

Figure 2:
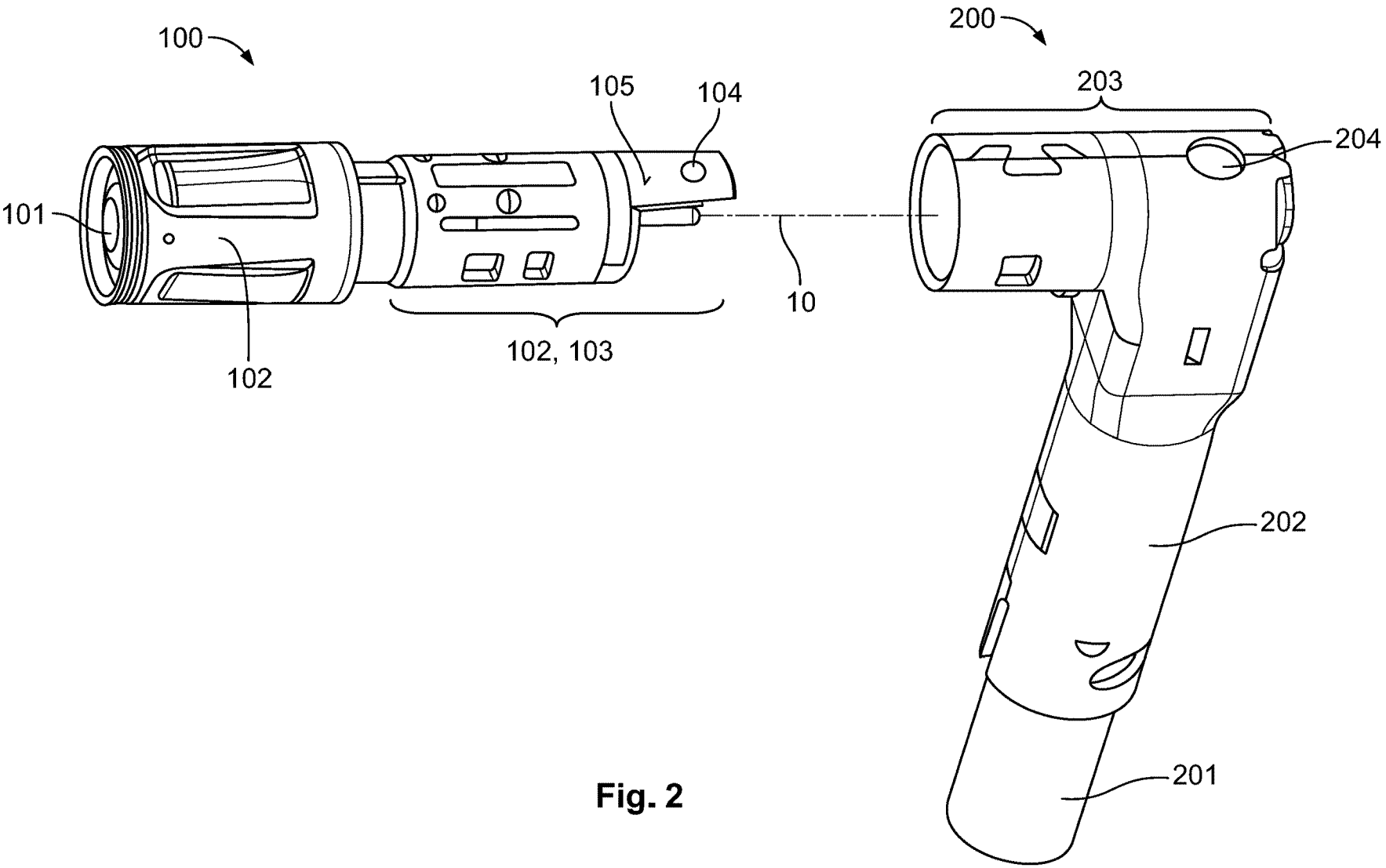
FIG. 2 shows a first plug connector and a second plug connector of the plug connector system.

FIG. 2 schematically shows the first plug connector 100 and the second plug connector 200 for the plug connector system 1 of FIG. 1 in a perspective view. In contrast to FIG. 1, the first plug connector 100 and the second plug connector 200 are not mated.

During the mating of the plug connector system 1, the problem arises that the first shield 102 of the first plug connector 100 can be moved in a first axial direction 10 within the second shield 202 of the second plug connector 200. Moreover, the first shield 102 can be rotated about the first axial direction 10 within the second shield 202. Accordingly, the first plug connector 100 and the second plug connector 200 may be positioned and orientated in such a way that a proper connection between the first plug connector 100 and the second plug connector 200 cannot be ensured. Within the context of this description, a proper connection refers to a connection which is mechanically stable and which is reliable in terms of its electrical properties.

To overcome this problem, the engagement portion 103 of the first shield 102 has a marking 104. The marking 104 is arranged on an outer side 105 of the first shield 102. By way of example, the marking 104 has a circular design. However, the marking 104 can also have a different design, for example the marking 104 can be designed as a cross. The marking 104 can be produced by a machining process, for example, in which the first shield 102 is irradiated with a laser. Alternatively, the marking can 104 can also be generated in another manner, for example by means of a mechanical embossing process, for example by means of a stamping process. The receiving portion 203 has a through-opening 204. By way of example, the through-opening 204 has a circular design. However, the through-opening 204 can have a different design, for example a rectangular design. The through-opening 204 can be generated in the second shield 202 by means of a boring process or by means of a punching process, for example.

Figure 3:
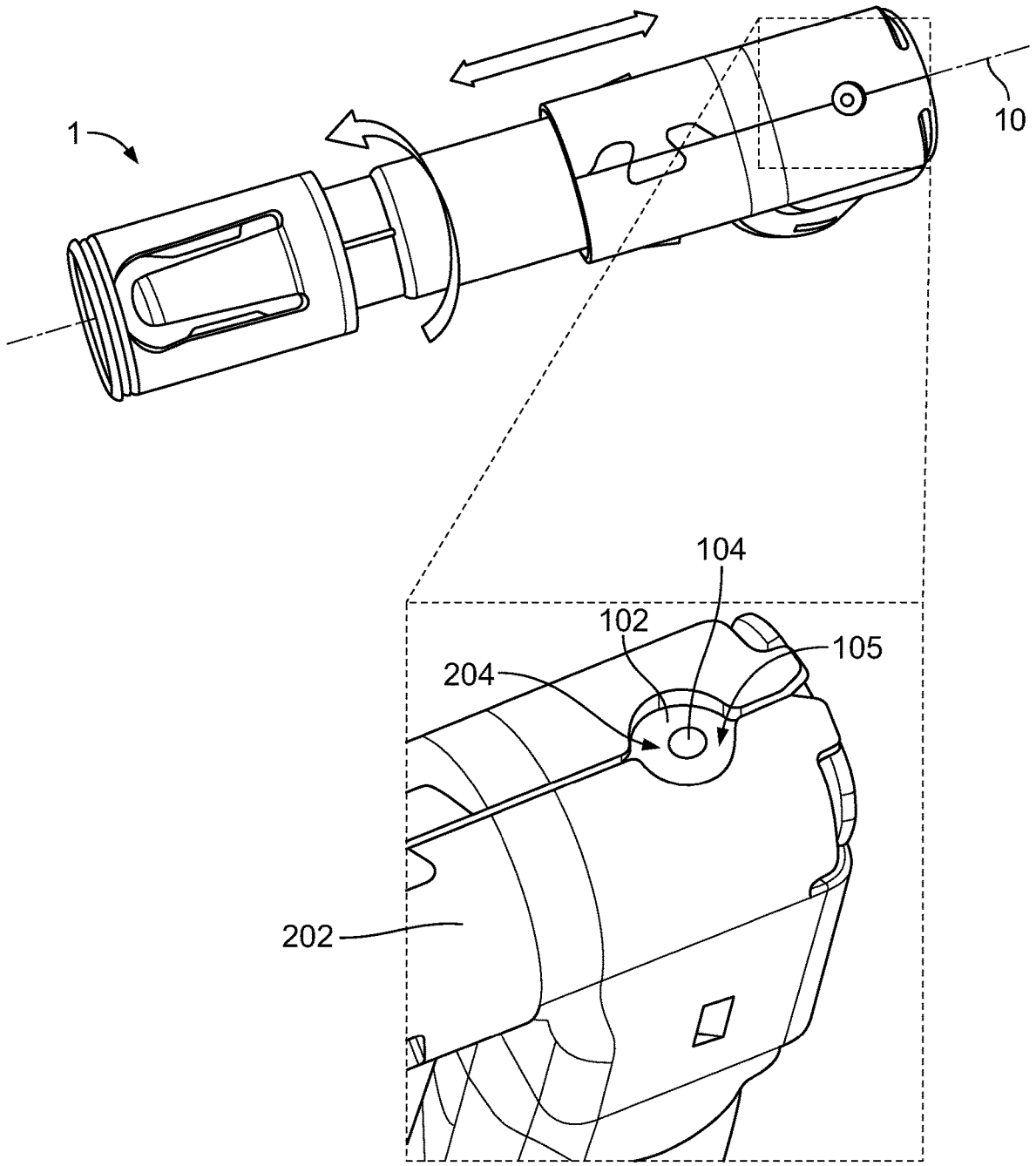
FIG. 3 shows the plug connector system of FIG. 1 in a top plan view and a portion of the plug connector system in a perspective and enlarged view.

FIG. 3 schematically shows the plug connector system 1 of FIG. 1 in a plan view and a portion of the plug connector system 1 according to a region marked in FIG. 3 in a perspective and enlarged view.

The marking 104 and the through-opening 204 are positioned in such a way that the marking 104 can be arranged entirely in the region of the through-opening 204, whereby the marking 104 is fully visible. By way of example, FIG. 3 shows a scenario in which the first shield 102 engages in the second shield 202 in such a way that the marking 104 is arranged by way of example in a centre of, or concentrically with, the through-opening 204, whereby the marking 104 is fully visible. In this case, therefore, a proper connection between the first plug connector 100 and the second plug connector 200 can be ensured as the first shield 102 engages in the second shield 200 in such a way that a mechanically and electrically reliable connection can be enabled. The dimensions of the engagement portion 103 provided to engage in the second shield 202 and, conversely, the receiving portion 204 provided to receive the first shield 102, are determined by the combination of the position of the marking 104 on the outer side 105 of the first shield 102 and the position of the through-opening 204 in the second shield 204.

Figure 4:
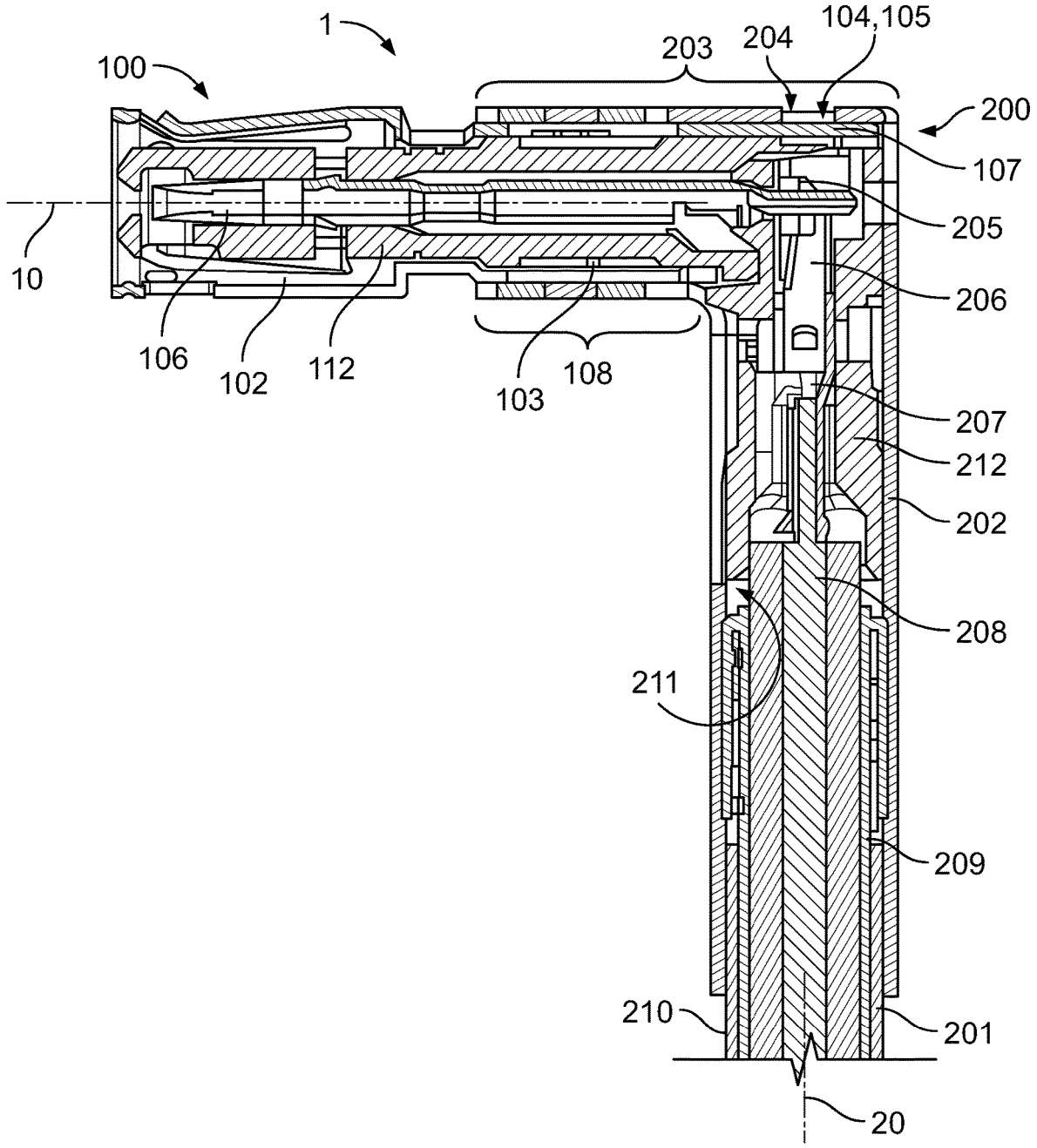
FIG. 4 shows the plug connector system of FIG. 1 in a cross-sectional view.

FIG. 4 schematically shows the plug connector system of FIG. 1 in a cross-sectional view. In this case, the cross-section extends along a plane spanned by the first axial direction 10 and a second axial direction 20, such that components in the interior of the first plug connector 100 and the second plug connector 200 can be seen in the cross-sectional view.

The first plug connector 100 has a first contact element 106. The first contact element 106 and the first shield 102 may be arranged concentrically. The first contact element 106 can contain copper or another conductive material, for example. The first contact element 106 can additionally be silver-plated or tin-plated. By way of example only, the first contact element 106 has a circular cross-section. The first contact element 106 is designed by way of example as a sleeve at the first connection 101. However, the first contact element 106 can also be designed differently, for example as a pin, at the first connection 101. The first plug connector 100 can also have a different number of first contact elements 106.

The second plug connector 200 has a second contact element 206. The second contact element 206 and the second shield 203 may be arranged concentrically. The second contact element 206 can contain copper or also another electrically conductive material, for example. The second contact element 206 can be tin-plated. The second plug connector 200 can also have a different number of second contact elements 206. The first contact element 106 of the first plug connector 100 is provided to be electrically and mechanically connected to the second contact element 206 of the second plug connector 200. In FIG. 4, the contact elements 106, 206 in the plug connector system 1 are properly connected to one another. In this case, the marking 104 is arranged entirely within the through-opening 204 and is therefore fully visible.

In the exemplary embodiment of the plug connector system 1, the through-opening 204 is arranged in the region of a contact structure 205 of the second contact element 206 designed to receive the first contact element 106. This enables an inspection during the installation of the second contact element 206 within the second shield 202 of the second plug connector 200. The contact structure 205 of the second contact element 206 must namely be positioned in such a way that the first contact element 106 can engage in the contact structure 205. To this end, the second contact element 206 must be positioned in such a way that the contact structure 205 is at a predetermined spacing from the through-opening 204. This is enabled in that the through-opening can be used for inspection purposes. However, the through-opening 204 does not necessarily have to be arranged in the region of the contact structure 205.

To receive the first contact element 106, the contact structure 205 can be designed as a contact fork, for example. This enables a construction in which the first contact element 106 and the second contact element 206 are arranged perpendicularly to one another as the first contact element 106 can engage between two fork portions of the contact structure 205 designed as a contact fork. To this end, the first contact element 106 is designed as a pin at an end opposite the first connection 101. However, the contact structure 205 does not necessarily have to be embodied as a contact fork. If the first contact element 106 has a different design at the end opposite the first connection 101, the contact structure 205 can likewise have a different design in order to be able to receive the first contact element 106. For example, the first contact element 106 could be embodied as a sleeve at the end opposite the first connection 101. In this case, it is expedient that the contact structure is embodied as a pin.

The second contact element 206 has a further contact structure 207 on a side of the second contact element 206 which is opposite the contact structure 205. The further contact structure 207 is designed to receive an inner conductor 208 of the coaxial cable 201. In the plug connector system 1, the inner conductor 208 of the coaxial cable 201 is connected to the second contact element 206 via the further contact structure 207. The coaxial cable 201 furthermore has an outer conductor 209 and an insulation 210. The outer conductor 209 of the coaxial cable 201 abuts against an inner side 211 of the second shield 202 and is electrically connected to the second shield 202.

The through-opening 204 in the second shield 202 is disadvantageous in that a shielding function of the second shield 202 cannot be fulfilled in the region of the through-opening 204. However, a part of the first shield 102 which is arranged in the region of the through-opening 204 is advantageously designed to assume the shielding function in the region of the through-opening 204. An electromagnetic compatibility of the plug connector system 1 can thus be improved, whereby a trouble-free exchange of data can take place via the plug connector system 1.

In the exemplary embodiment of the plug connector system 1, the first contact element 106 and the second contact element 206 are arranged perpendicularly to one another, whereby the plug connector system 1 as a whole is designed as a 90° terminal. So that the problem of the shielding in the region of the through-opening 204 does not also occur in this case, in the plug connector system 1, a segment 107 of the engagement portion 103 of the first shield 102 which has the marking 104 is longer than a remaining segment 108 of the engagement portion 103. The segment 107 having the marking 104 thus projects in the first axial direction 10 and into the second shield 202 to the extent that the through-opening 204 is covered by part of the segment 107. The remaining segment 108, on the other hand, does not project so far into the second shield 202 as it would strike the second contact element 206. The segment 107 of the engagement portion 103 which has the marking 104 and the remaining segment 108 can therefore each have a semi-cylindrical design or the like, wherein the segment 107 is longer than the remaining segment 108. In other words, the engagement portion 103 of the first shield 102 has a recess on a side opposite the marking 104. The recess is provided to receive the second contact element 206 arranged perpendicularly to the first contact element 106.

The first plug connector 100 further comprises a first dielectric insert 112 arranged within the first shield 102. The first contact element 106 is arranged within the first dielectric insert 112. The second plug connector 200 has a second dielectric insert 212 arranged within the second shield 202. The second contact element 206 is arranged within the second dielectric insert 212. The dielectric inserts 112, 212 each contain a plastic, for example, and can be produced by means of a moulding process, for example. The dielectric inserts 112, 212 can each contain polybutylene terephthalate (PBT). The dielectric inserts 112, 212 can additionally be glass-fibre reinforced. For example, the dielectric inserts can contain 15% glass-fibre reinforced PBT (PBT GF 15).

Figure 5:
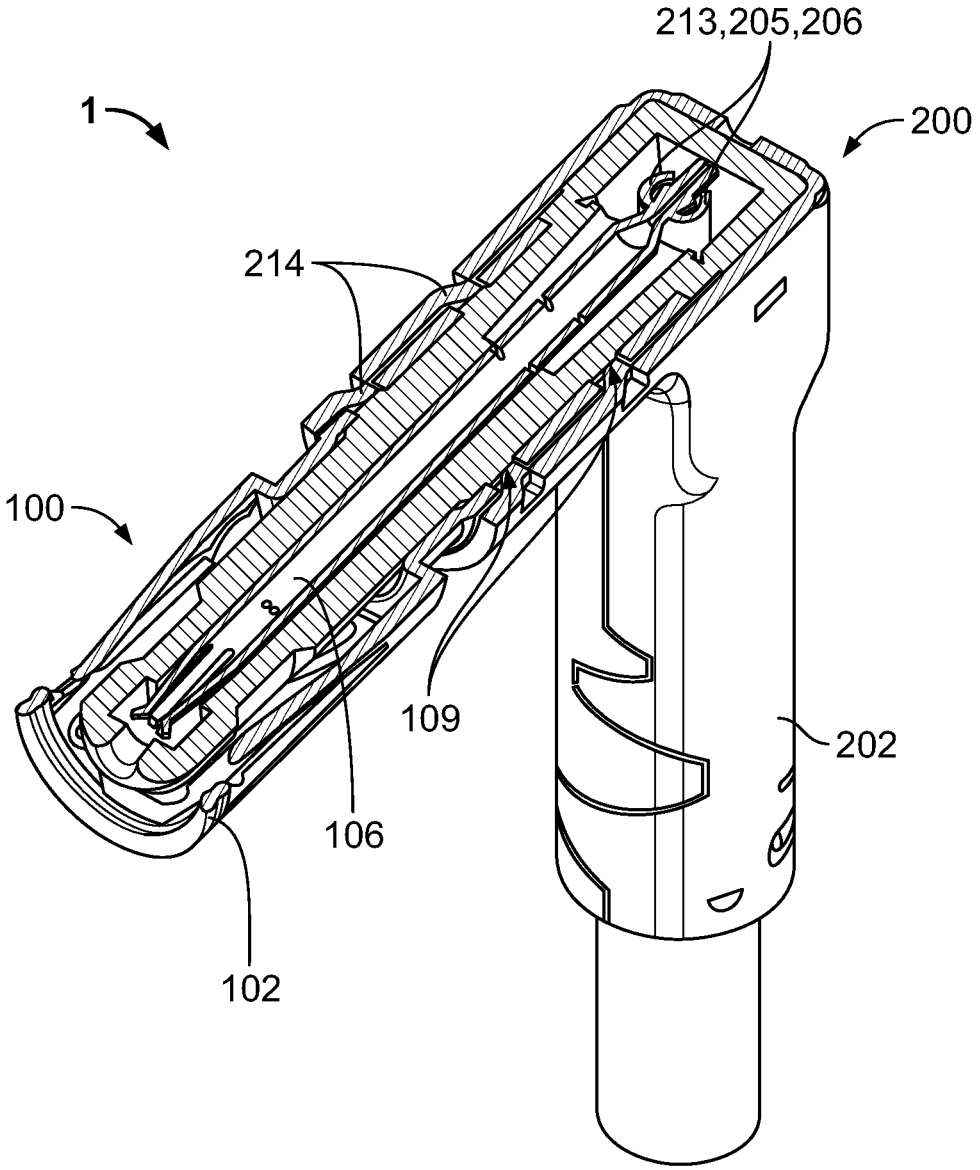
FIG. 5 shows the plug connector system of FIG. 1 in a further cross-sectional view.

FIG. 5 schematically shows another cross-sectional view of the plug connector system 1. In this case, the cross-section extends along a plane which comprises the first axial direction 10 and which extends perpendicularly to the second axial direction 20, whereby, in particular, elements can be seen in the interior of the first plug connector 100. The contact structure 205, embodied as a contact fork, of the second contact element 206 can also be seen in FIG. 5. The first contact element 106 reaches between two fork portions 213 of the contact structure 205, whereby the first contact element 106 and the second contact element 206 are mechanically and electrically connected to one another.

To further enable the first shield 102 and the second shield 202 to be reliably mechanically and electrically connected to one another, the engagement portion 103 has openings 109. The receiving portion 203 has contact elements, embodied as deformable contact tabs or contact lamellae 214. The openings 109 are provided to receive the contact lamellae 214. To connect the first shield 102 and the second shield 202 to one another, the contact lamellae 214 can be pressed (e.g., plastically deformed) into the openings 109. The first shield 102 has at least two mutually opposing openings 109. The second shield 202 has at least two mutually opposing contact lamellae 214. The exemplary plug connector system 1 has a total of four openings 109 and four contact lamellae 214, of which mutual pairs are arranged on opposite sides of the respective shields 102, 202.

In the plug connector system 1, the first shield 102 and the second shield 202 are press-fitted to one another by means of the openings 109 and the contact lamellae 214. The shields 102, 202 are thus properly connected to one another. In this case, the marking 104 is arranged entirely within the through-opening 204 and is fully visible. The marking 104 is therefore fully visible when the openings 109 are arranged in regions of the contact lamellae 214, whereby the first shield 102 and the second shield 202 can subsequently be press-fitted to one another by pressing the contact lamellae 214 into the openings 109.

Figure 6:
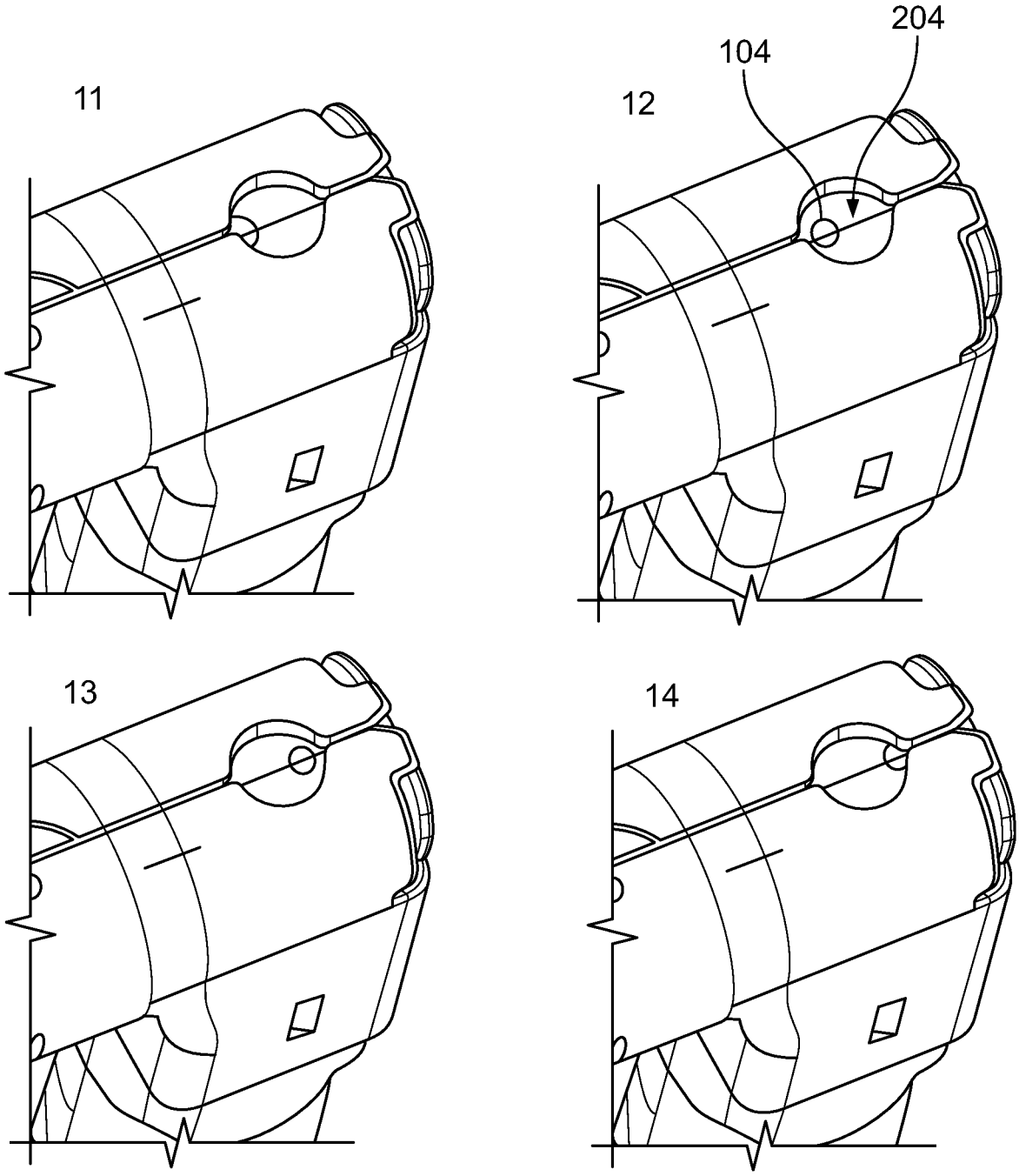
FIG. 6 shows four different positions of a marking of a first plug connector relative to a through-opening of a second plug connector depending on a position of the first plug connector with respect to an axial direction.

FIG. 6 schematically shows four different exemplary scenarios 11, 12, 13, 14 for a position of the marking 104 relative to the through-opening 204 depending on a position of the first shield 102 with respect to the first axial direction 10.

In a first exemplary scenario 11, the first shield 102 does not engage far enough in the second shield 202 for the first contact element 106 and the second contact element 206 to be mechanically and electrically connected to one another in a reliable manner. In addition, it may be that the first shield 102 also does not engage far enough in the second shield 202 to enable the first shield 102 to be mechanically and electrically connected to the second shield 202 as the openings 109 are not arranged in the region of the contact lamellae 214, as a result of which they cannot be press-fitted to one another. For this reason, the marking 104 is not arranged entirely in the region of the through-opening 204 and is not fully visible. Therefore, a proper connection, established between the first plug connector 100 and the second plug connector 200, cannot be ensured.

In a second exemplary scenario 12, the first shield 102 engages more deeply in the second shield 202 than in the first scenario 11, specifically in such a way that the marking 104 is fully visible. The first contact element 106 and the second contact element 206 can therefore be mechanically and electrically connected to one another in a reliable manner. It may also be that the openings 109 are arranged in the region of the contact lamellae 14, whereby a proper connection between the first plug connector 100 and the second plug connector 200 can be established.

In a third exemplary scenario 13, the first shield 102 engages more deeply in the second shield 202 than in the second scenario 12, specifically in such a way that the marking 104 is still fully visible. The first contact element 106 and the second contact element 206 can therefore be mechanically and electrically connected to one another in a reliable manner. The openings 109 in this case can likewise be arranged in the region of the contact lamellae 14, whereby a proper connection between the first plug connector 100 and the second plug connector 200 can be established.

In a fourth exemplary scenario 14, the first shield 102 engages more deeply in the second shield 202 than in the third scenario 13, specifically in such a way that the marking 104 is no longer fully visible. The first contact element 106 and the second contact element 206 can therefore no longer be mechanically and electrically connected to one another in a reliable manner. For example, it may be that the second contact element 202 becomes damaged when the first shield 102 engages so deeply in the second shield 202. Moreover, it may be that the first shield 102 engages so deeply in the second shield 202 that the openings 109 are no longer arranged in the region of the contact lamellae 14, whereby a proper connection between the first plug connector 100 and the second plug connector 200 cannot be ensured.

Figure 7:
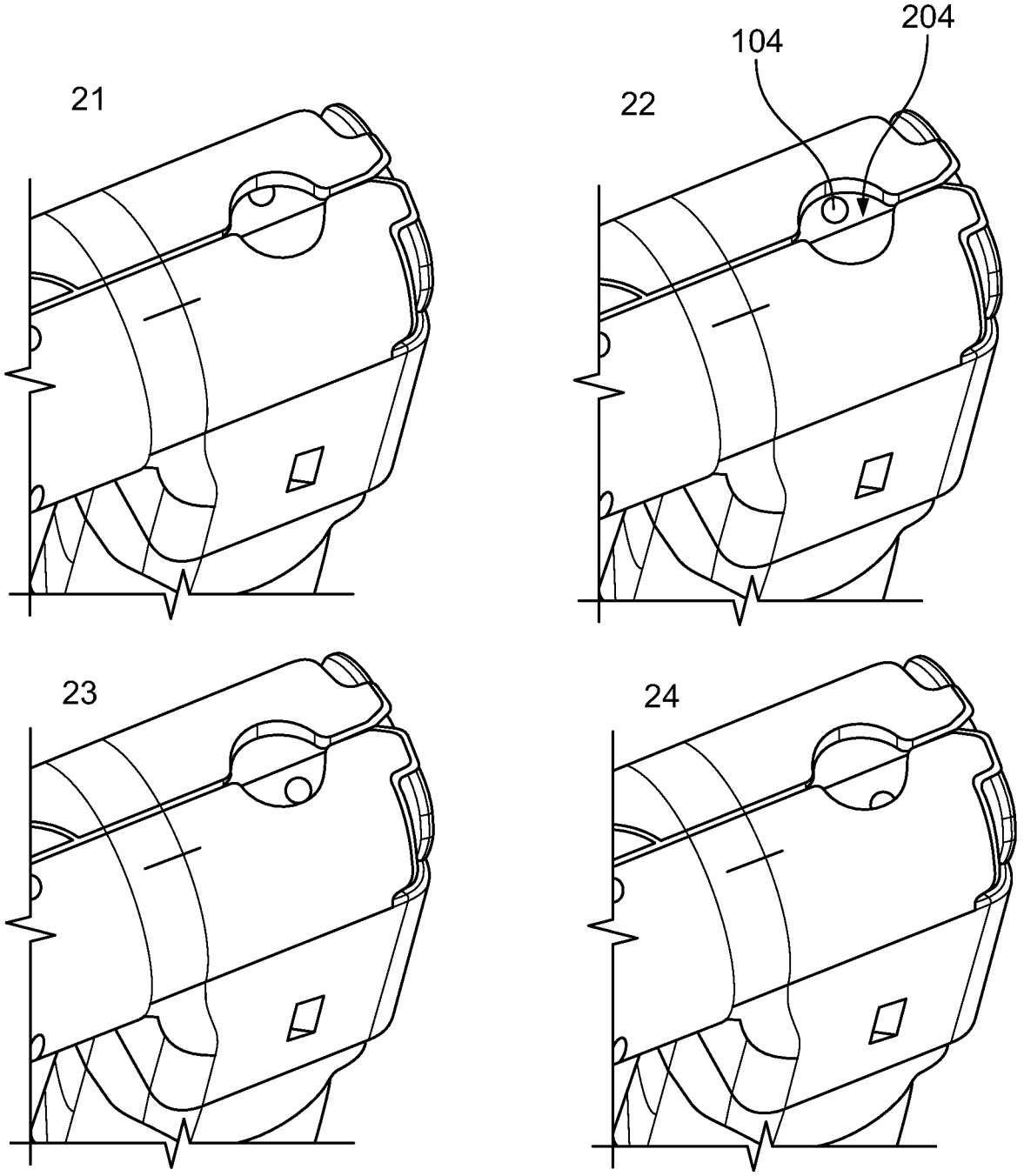
FIG. 7 shows four further positions of the marking relative to the through-opening depending on a rotation of the first plug connector with respect to the axial direction.

FIG. 7 schematically shows four further different exemplary scenarios 21, 22, 23, 24 for a position of the marking 104 relative to the through-opening 204 depending on a rotation of the first shield 102 with respect to the first axial direction 10.

In a fifth exemplary scenario 21, the first shield 102 is rotated within the second shield 202 in such a way that the openings 109 are not arranged in the region of the contact lamellae 214, whereby the first shield 102 and the second shield 202 cannot be press-fitted to one another. For this reason, the marking 104 is not arranged entirely in the region of the through-opening 204 and is not fully visible. Therefore, a proper connection between the first plug connector 100 and the second plug connector 200 cannot be ensured.

In a sixth exemplary scenario 22, in relation to the fifth scenario 21, the first shield 102 is rotated within the second shield 202 in such a way that the openings 109 are arranged in the region of the contact lamellae 214, whereby the first shield 102 and the second shield 202 can be press-fitted to one another. For this reason, the marking 104 is arranged entirely in the region of the through-opening 204 and is fully visible. A proper connection between the first plug connector 100 and the second plug connector 200 can thus be established.

In a seventh exemplary scenario 23, in relation to the sixth scenario 22, the first shield 102 is rotated within the second shield 202 in such a way that the openings 109 are still arranged in the region of the contact lamellae 214, whereby the first shield 102 and the second shield 202 can be press-fitted to one another. The marking 104 is arranged entirely in the region of the through-opening 204 and is fully visible. A proper connection between the first plug connector 100 and the second plug connector 200 can thus be established.

In an eighth exemplary scenario 24, in relation to the seventh scenario 23, the first shield 102 is rotated within the second shield 202 in such a way that the openings 109 are no longer arranged in the region of the contact lamellae 214, whereby the first shield 102 and the second shield 202 cannot be press-fitted to one another. For this reason, the marking 104 is not arranged entirely in the region of the through-opening 204 and is not fully visible. Therefore, a proper connection between the first plug connector 100 and the second plug connector 200 cannot be ensured.

In addition to the scenarios 11, 12, 13, 14, 21, 22, 23, 24 shown in FIG. 6 and FIG. 7, other scenarios are also conceivable. In particular, the first shield can be moved and simultaneously rotated within the second shield, whereby a wide variety of different scenarios are conceivable.

Figure 8:
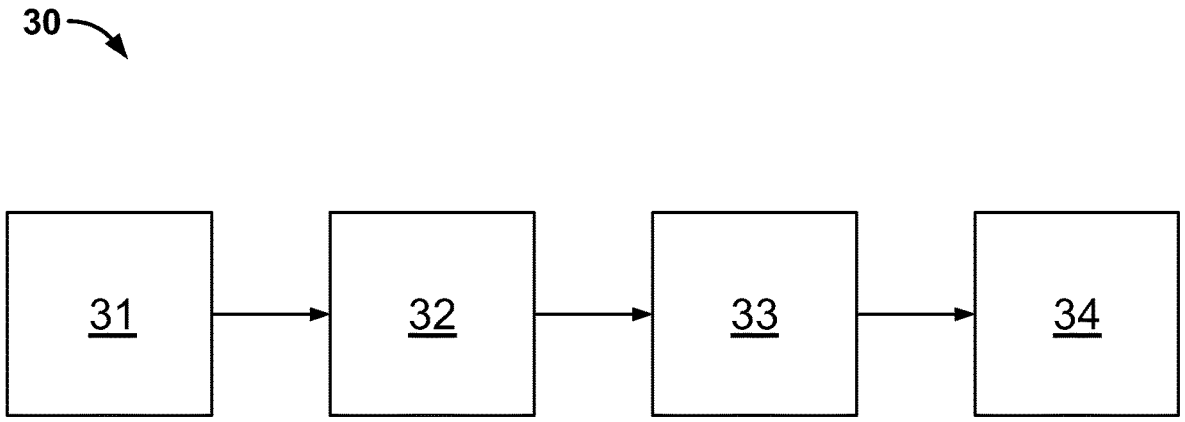
FIG. 8 shows a method for producing the plug connector system.

FIG. 8 schematically shows method steps 31, 32, 33, 34 of a method 30 for producing the plug connector system 1.

Within the context of a first method step 31, the first shield 102, provided with the marking 104, of the first plug connector 100 is inserted into the second shield 202 of the second plug connector 200. This can take place either manually or automatically by means of an automation system which has corresponding sensors and actuators in order to enable the first method step 31 to be carried out.

Within the context of a second method step 32, it is checked whether the marking 104 is arranged in the region of the through-opening 204 of the second shield 202 and is fully visible therein. This step can also take place manually or automatically. To automatically check whether the marking 104 is arranged entirely within the through-opening 204 and is fully visible, the automation system can have a detection device and an evaluation device. The third method step 33 is also suitable for checking by means of the second plug connector 200 whether the first plug connector 100 is connected to a device in a defined manner, for example. In this case, it can be checked in particular whether the first plug connector 100 has a defined rotation.

Within the context of an optional third method step 33, the first plug connector 100 is moved in the first axial direction 10 and/or rotated about the axial direction 10 in order to position the marking 104 in the region of the through-opening 204 in such a way that the marking 104 is fully visible if the marking 104 is not fully visible after the checking method step 32. The optional method step can also take place manually or automatically.

Within the context of an optional fourth method step 34, the first shield 102 and the second shield 202 are press-fitted to one another if the marking 104 is fully visible. For example, an actuator of the automation system can be designed for this purpose.

It should be appreciated for those skilled in this art that the above embodiments are intended to be illustrated, and not restrictive. For example, many modifications may be made to the above embodiments by those skilled in this art, and various features described in different embodiments may be freely combined with each other without conflicting in configuration or principle.

Although several exemplary embodiments have been shown and described, it would be appreciated by those skilled in the art that various changes or modifications may be made in these embodiments without departing from the principles and spirit of the disclosure, the scope of which is defined in the claims and their equivalents.

As used herein, an element recited in the singular and proceeded with the word "a" or "an" should be understood as not excluding plural of said elements or steps, unless such exclusion is explicitly stated. Furthermore, references to "one embodiment" of the present disclosure are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

What is claimed is:

1. A plug connector system, comprising:

a first plug connector including a first contact element and a first shield defining an engagement portion, an outer side of the engagement portion having a marking positioned thereon; and a second plug connector including a second contact element for connecting to the first contact element and a second shield defining a receiving portion for receiving the engagement portion of the first shield, the receiving portion having an opening formed therethrough and positioned such that the marking of the first plug connector can be arranged within the region of the opening in a mated state of the first and second plug connectors, the engagement portion having openings receiving respective additional contact elements of the receiving portion, the first shield and the second shield press-fitted to one another by deforming the additional contact elements into the openings.

2. The plug connector system according to claim 1, wherein the second contact element defines an opening receiving the first contact element in the mated state, the first contact element and the second contact element being mechanically and electrically connected to one another in the mated state.

3. The plug connector system according to claim 2, wherein the first contact element and the second contact element are arranged perpendicularly to one another in the mated state.

4. The plug connector system according to claim 3, wherein the second contact element includes a contact fork for receiving the first contact element in the mated state.

5. The plug connector system according to claim 4, wherein the opening is arranged in the region of the contact fork.

6. The plug connector system according to claim 2, wherein the first contact element and the first shield are arranged concentrically, and the second contact element and the second shield are arranged concentrically.

7. The plug connector system according to claim 1, wherein a segment of the engagement portion which has the marking is longer than a remaining segment of the engagement portion.

8. The plug connector system according to claim 1, wherein the entire marking is visible through the opening in the mated state.

9. A plug connector for a plug connector system, comprising:

a first contact element for connecting to a second contact element of a mating plug connector of the plug connector system; and a first shield at least partially covering the first contact element and including an engagement portion for engaging with a second shield of the mating plug connector, an outer side of the engagement portion having a marking positioned such that it is fully visible through an opening in the second shield when the first contact element and the second contact element are mechanically and electrically connected to one another, the engagement portion having openings for receiving respective additional contact elements of the mating plug connector, the marking being fully visible when the openings are arranged in regions of the additional contact elements.

10. The plug connector according to claim 9, wherein the first contact element and the first shield are arranged concentrically.

11. The plug connector according to claim 9, wherein a segment of the engagement portion which has the marking is longer than a remaining segment of the engagement portion.

12. A method for mating a first plug connector to a second plug connector of a plug connector system, the method including the steps of:

inserting a first shield of the first plug connector into a second shield of the second plug connector, the first shield having a marking positioned on an outer side thereof;

inspecting an opening formed in the second shield for determining if the marking is fully visible through the opening; and if the marking is fully visible through the opening, press-fitting the first shield and the second shield to one another by deforming a plurality of contact elements of the second shield into respective ones of a plurality of openings of the first shield.

13. The method of claim 12, further comprising the step of, if the marking is not fully visible after the inspecting step, at least one of axially translating or rotating the first plug connector relative to the second plug connector for positioning the marking fully within the opening.

14. A plug connector system, comprising:

a first plug connector including a first contact element and a first shield defining an engagement portion, an outer side of the engagement portion having a marking positioned thereon; and a second plug connector including a second contact element and a second shield defining a receiving portion for receiving the engagement portion of the first shield, the receiving portion having an opening formed therethrough and positioned such that the marking of the first plug connector can be arranged within the region of the opening in a mated state of the first and second plug connectors, the first contact element and the second contact element arranged perpendicularly to one another and mechanically and electrically connected to one another in the mated state.

15. The plug connector system according to claim 14, wherein the first contact element extends longitudinally along a first axial direction and the second contact element extends longitudinally along a second axial direction, the first axial direction and the second axial direction oriented perpendicular to one another in an area of mechanical connection of the first contact element and the second contact element.

16. The plug connector system according to claim 14, wherein first plug connector is insertable into the second plug connector independent of a radial position of the marking relative to the receiving portion.

17. The plug connector system according to claim 14, wherein the marking does not extend into the opening of the receiving portion in the mated state of the first and second plug connectors.

18. The plug connector system according to claim 14, wherein the engagement portion has openings receiving respective additional contact elements of the receiving portion, the first shield and the second shield are press-fitted to one another by deforming the additional contact elements into the openings.

19. The plug connector system according to claim 14, wherein the engagement portion has openings for receiving respective additional contact elements of the mating plug connector, the marking being fully visible when the openings are arranged in regions of the additional contact elements.

20. The plug connector according to claim 19, wherein the plug connector is adapted to be press-fit to the mating plug connector by deforming the additional contact elements into the openings.

* * * * *